US009618295B1

(12) United States Patent
Rentz

(10) Patent No.: US 9,618,295 B1
(45) Date of Patent: Apr. 11, 2017

(54) ADJUSTABLE ARCHERY RELEASE

(71) Applicant: Gregory E. Summers, Madison Heights, VA (US)

(72) Inventor: Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 15/201,857

(22) Filed: Jul. 5, 2016

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS

| | | | | |
|---|---|---|---|---|
| 5,694,915 | A | 12/1997 | Summers | |
| 8,622,051 | B2 * | 1/2014 | Summers | F41B 5/1469 124/35.2 |
| 8,746,221 | B2 * | 6/2014 | Rentz | F41B 5/1469 124/1 |
| 9,250,032 | B2 * | 2/2016 | Kelly | F41B 5/1469 |
| 9,255,762 | B2 * | 2/2016 | Kelly | F41B 5/1469 |
| 2008/0149084 | A1 * | 6/2008 | Whalen | F41B 5/1469 124/35.2 |
| 2012/0285431 | A1 * | 11/2012 | Summers | F41B 5/1469 124/35.2 |
| 2013/0092140 | A1 * | 4/2013 | Rentz | F41B 5/1469 124/35.2 |

* cited by examiner

*Primary Examiner* — Alexander Niconovich
(74) *Attorney, Agent, or Firm* — Leading-Edge Law Group, PLC

(57) ABSTRACT

A handheld archery release includes a handle and a first finger piece which is removably and adjustably connected with the handle to provide radial adjustment of the release. Preferably, a second finger piece is removably and adjustably connected with the first finger piece. Adjusting the finger pieces forward creates a flatter hand feel and provides a faster back-tension speed for shot execution. Adjusting the finger pieces rearward or backward creates a larger arcuate shape for a more swept hand feel and a slower back-tension speed for shot execution.

7 Claims, 4 Drawing Sheets

ADJUSTABLE ARCHERY RELEASE

BACKGROUND OF THE INVENTION

The present invention relates to an archery release for a bowstring which includes interchangeable and radially adjustable finger pieces.

Release devices are used in archery to assist the archer in pulling a bowstring to a fully drawn position and then releasing the bowstring to fire an arrow. Some release devices use grippers for engaging the bowstring or a hock mounted on the bowstring. Other release devices use a rope looped about the bowstring. Still other devices use back tension which eliminates the torque in looped rope releases. The present invention relates to adjustable finger pieces for a hand-held release to increase or decrease back-tension speed for shot execution.

BRIEF DESCRIPTION OF THE PRIOR ART

Archery release devices are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension on the rope loop. Set screws are used to hold the fork and the catch in the desired positions.

Another back-tension release device is disclosed in U.S. Pat. No. 8,622,051 wherein an adjustable sear housing and an adjustable finger are provided. By adjusting the sear housing, twist or torque in a bowstring loop connected with the release can be eliminated. The speed of the release is altered via adjustment of the finger.

While the prior devices normally operate satisfactorily, none include finger portions which are radially adjustable to provide changes in the shape of the handle to accommodate the preferences of the archer. In addition, they do not accommodate various shooting styles.

SUMMARY OF THE INVENTION

The present invention was developed in order to overcome these and other drawbacks of prior archery releases by providing an archery release with interchangeable and radially adjustable finger pieces. The release includes a handle having a longitudinal axis and at least one finger piece or portion removably and adjustably connected with an end of the handle to provide radial adjustment of the release in accordance with the preferences of the archer.

In a preferred embodiment, the handle end contains a channel and a first end of the finger piece contains a transverse arcuate slot. The finger piece first end is arranged in the handle channel and a locking screw is provided which passes through openings in the handle and the slot in the finger piece to connect the finger piece with the handle. The handle end further contains a concave recess adjacent the channel and the finger piece first end further includes a pivot portion which rests in the concave recess of the handle when the finger piece is connected with the handle. With the locking screw in a released position, the finger piece pivots through an angle which is governed by the length of the slot. When the locking screw is tightened, the finger piece is locked into a selected radial position relative to the handle.

A second finger piece may be provided which is removably and adjustably connected with a second end of the first finger piece. Adjusting the finger pieces forward will create a flatter feel to the hand of the archer and provide a faster back tension speed for shot execution. Adjusting the finger pieces backward will create a larger arcuate shape for a more swept feel to the hand of the archer and a slower back tension speed for shot execution.

BRIEF DESCRIPTION OF THE FIGURES

Other objects and advantages of the invention will become apparent from a study of the following specification when viewed in the light of the accompanying drawing, in which.

DETAILED DESCRIPTION

The inventive interchangeable and adjustable finger pieces may be used with various types of archery releases, including a back tension release and a thumb trigger hand-held release. For illustrative purposes only, the invention will be described in connection with a hand-held back tension release.

Figure 3:
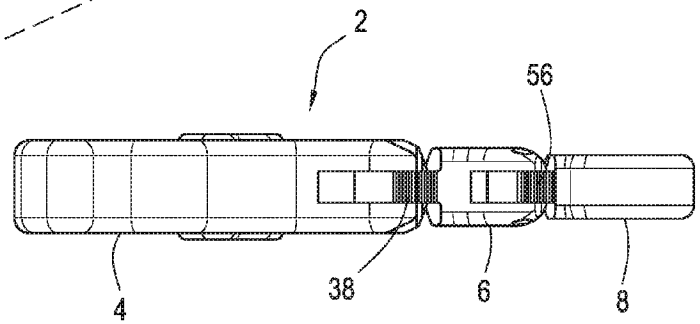
FIG. 3 is a bottom perspective view of the archery release.
Figure 2:
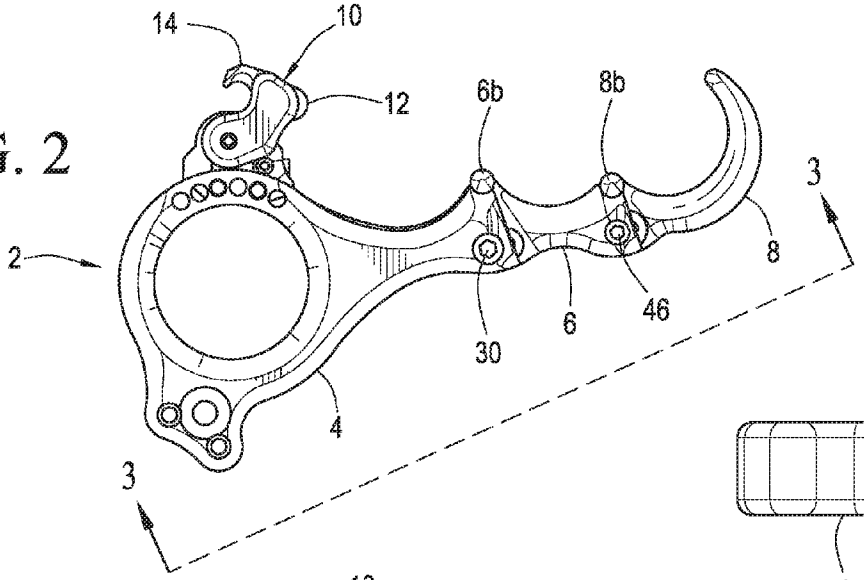
FIG. 2 is front plan view of the archery release.
Figure 1:
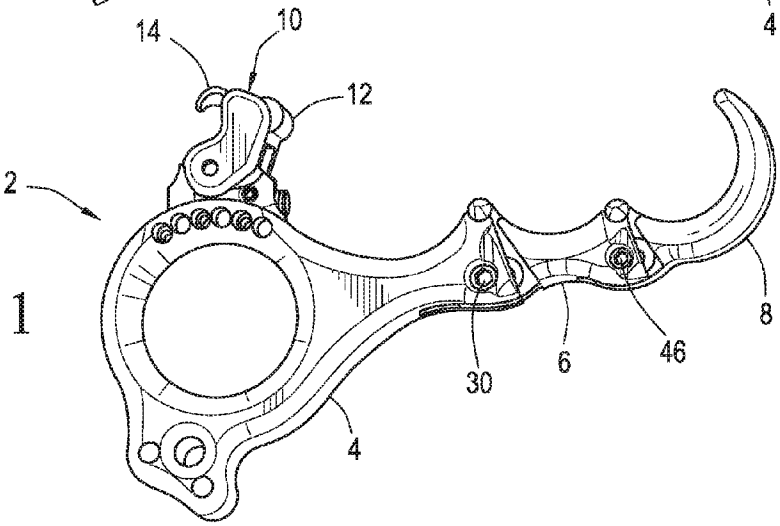
FIG. 1 is a front perspective view of the archery release according to the invention.
Figure 5:
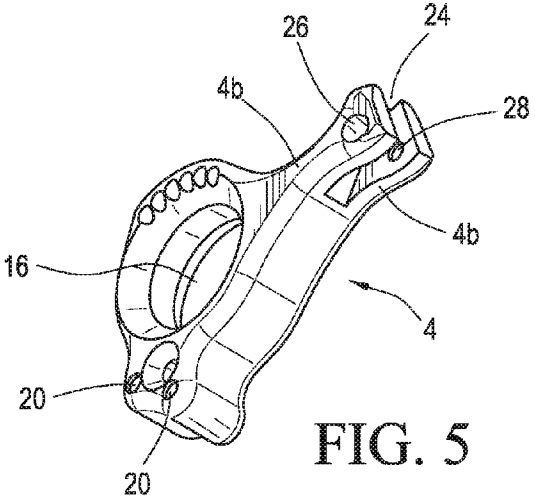
FIGS. 4 and 5 are top and bottom perspective views, respectively of the handle of the archery release.
Figure 8:
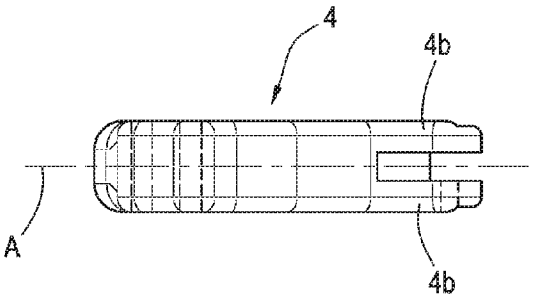
FIGS. 6-8 are front, right side, and bottom plan views, respectively, of the archery release handle according to the invention.
Figure 7:
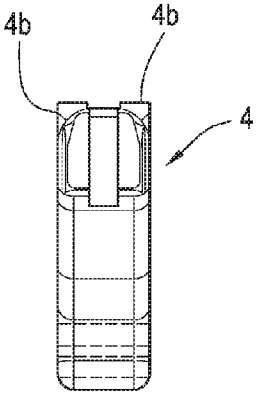
Figure 4:
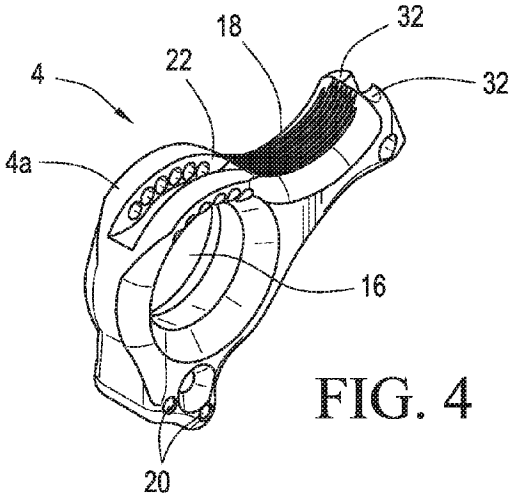
Figure 6:
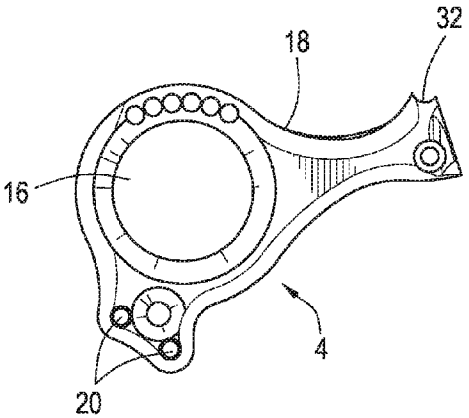
Figure 10:
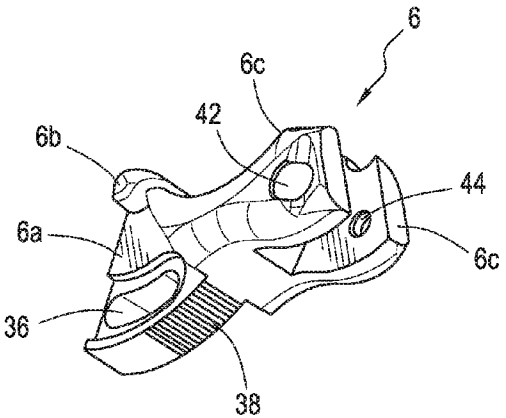
FIGS. 9 and 10 are top and bottom perspective views, respectively, of an archery release first finger piece according to the invention.
Figure 9:
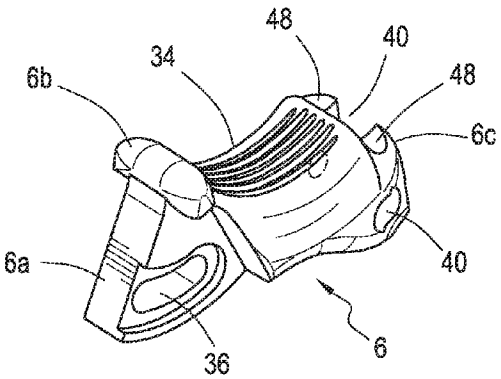
Figure 13:
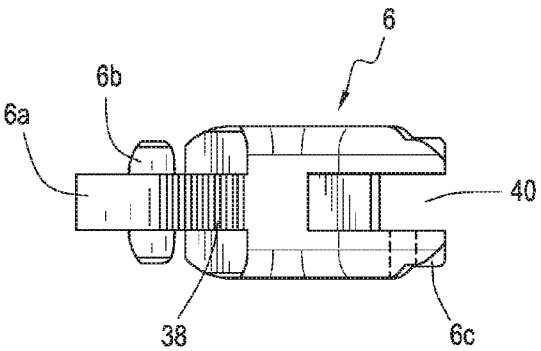
FIGS. 11-13 are front, right side, and bottom plan views, respectively, of the archery release first finger piece.
Figure 12:
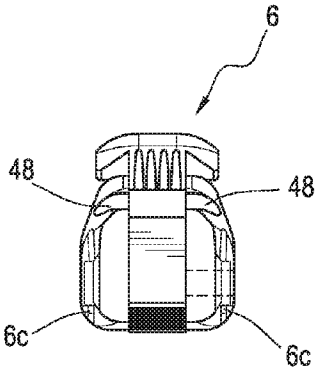
Figure 11:
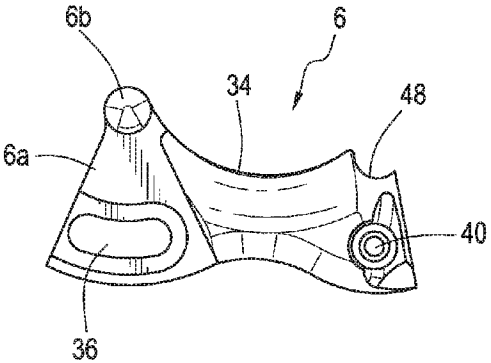
Figure 15:
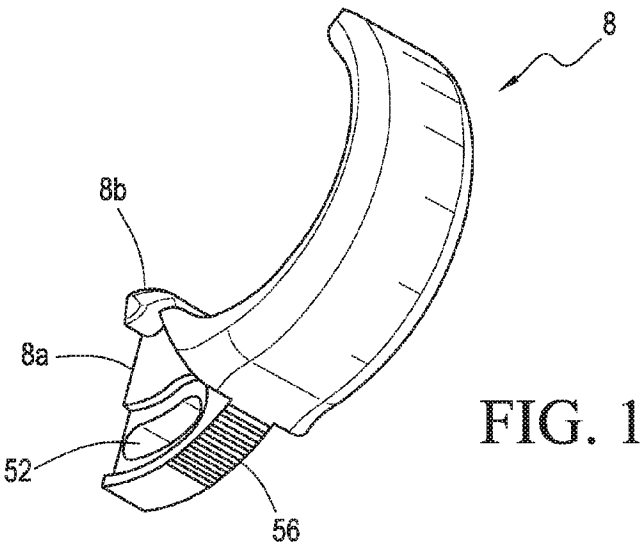
FIGS. 14 and 15 are front and right side plan views, respectively, of an archery release second finger piece according to the invention.
Figure 17:
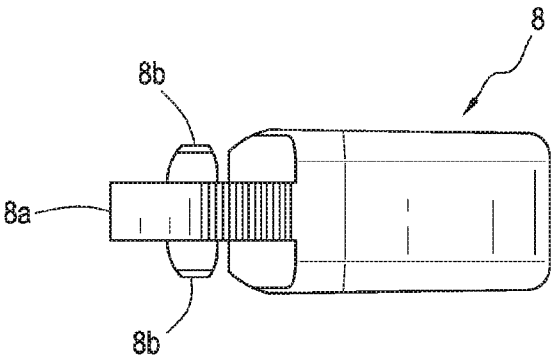
FIGS. 16 and 17 are front and bottom plan views, respectively, of the archery release second finger piece.
Figure 14:
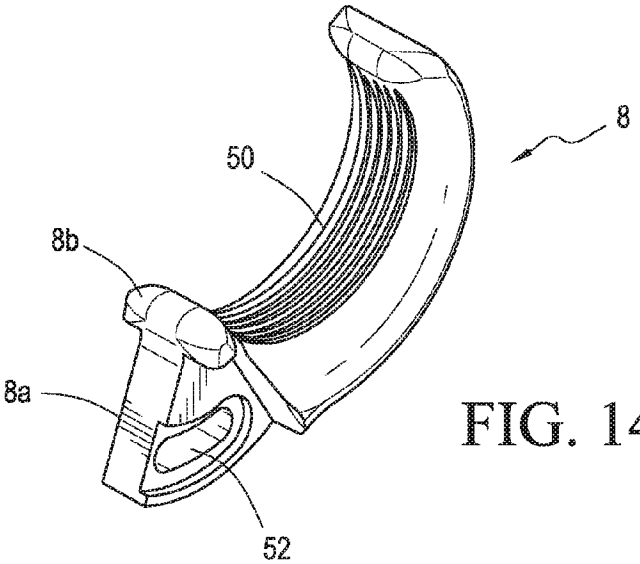
Figure 16:
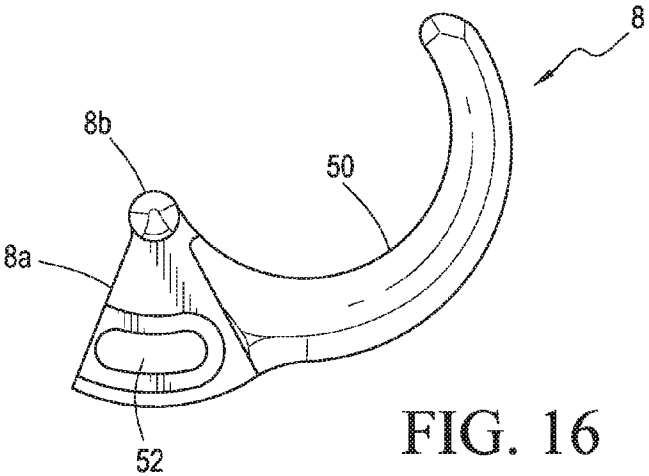

As shown in FIGS. 1-3, the handheld archery release includes a number of components which are shown in greater detail in FIGS. 4-17. More particularly, the release 2 includes a handle 4 having a longitudinal axis A (FIG. 8) and first 6 and a second 8 finger pieces or portions which will be described in greater detail below.

A sear assembly 10 is connected with the handle. The sear assembly 10 includes a sear 12 and bowstring hook 14. The bowstring hook 10 includes a gate portion (not shown) which engages the top of the sear when the gate portion is in the closed as is known in the art. The sear thus retains the bowstring hook in the closed position against the force of the bow draw weight. The bowstring hook is connected with a bowstring loop (not shown) of a bow. When the sear is pivoted upon back tension movement of the finger portions, the gate portion is released and the hook pivots under the force of the bow draw weight to a fire position to release the bowstring from the hook to fire an arrow.

The handle is shown in greater detail in FIGS. 4-8. It contains a central opening 16 for receiving the index finger of an archer and a concave portion 18 for receiving the archer's middle finger. Below the central opening toward its forward portion, the first member contains a spaced pair of threaded openings 20 which are adapted to receive a thumb pin (not shown). The thumb pin can be arranged in either opening according to the preferences of the archer and assists with drawing a bow. The pin can also be arranged in the threaded opening from the other side of the member depending on whether the archer is right or left-handed.

Above the opening 12, the handle 4 includes an upwardly extending portion 4*a* containing an upwardly facing recess 22 adapted to receive the sear assembly. Beyond the concave portion 18, the end of the handle 4 contains a channel 24 between spaced portions 4*b* of the handle. The spaced portions 4*b* of the handle contain aligned openings 26, 28 which are designed to receive a locking screw 30 as shown in FIGS. 1 and 2 and which will be discussed below. The upper surfaces of the spaced portions of the handle contain aligned concave recesses 32, respectively.

Referring now to FIGS. 9-13, the first finger piece 6 of the archery release will be described. The first finger piece includes an upper concave surface 34 which is configured to receive the ring finger of the archer. At one end of the first finger piece is a narrowed portion 6*a* which contains a transverse arcuate slot 36. Above the narrowed portion 6*a*, the first finger piece includes a transversely extending pivot portion 6*b*, the ends of which extend beyond the narrowed portion 6*a*. The pivot portion has a generally circular cross-sectional configuration.

The first finger piece 6 is connected with the handle by inserting the narrowed portion 6*a* between the spaced portions 4*b* of the handle and into the channel 24 with the opposite ends of the pivot portion 6*b* resting in the concave recesses 32 in the upper surface of the handle spaced portions 4*b*, respectively. When so arranged, the slot 36 of the first finger piece narrowed portion 6*a* is aligned with the aligned openings 26, 28 in the handle spaced portions 4*b*. A locking screw 30 is placed in the opening 26, passes through the slot 36, and into the opening 28 which is preferably a threaded opening. With the locking screw in a release (untightened) condition, the first finger piece can be pivoted with respect to the handle about the pivot portion 6*b*. From a neutral position, i.e. when the screw is arranged in the middle of the slot 36, the first finger piece can be radially pivoted in either direction. The extent of pivotal movement is a function of the arcuate length of the slot 36. By way of example only, if a slot of a given length affords a radial rotation of 15° in either direction from a neutral position, the total displacement would be up to 30°. Increasing the length of the slot would increase the degree of rotation. The archer thus adjusts the first finger piece relative to the handle to a desired location and tightens the locking screw 30. Tightening of the locking screw draws the spaced portions 4*b* of the handle against the narrowed portion of the first finger piece to clamp or lock it in the selected position relative to the handle. The bottom surface of the narrowed portion 6*a* of the first finger piece contains a plurality of alignment markings 38 which are used to indicate to the archer the selected radial position of the first finger piece relative to the handle.

While the first finger piece is shown with only one concave surface for receiving the ring finger of the archer's hand, it will be readily apparent that the first finger piece may be provided with a second concave surface adjacent and rearward of the first concave surface to receive and support the pinkie finger of the archer.

A preferred embodiment of the invention which provides even greater adjustability for the archer is to provide a second finger piece 8 removably and adjustably connected with the first finger piece 6 as shown in FIGS. 1-3.

Accordingly, the first finger piece 6 contains a connection assembly similar to that of the handle. That is, the other end of the first finger piece contains a channel 40 between spaced portions 6*c* of the first finger piece. The spaced portions 6*c* contain aligned openings 42, 44 which are designed to receive a locking screw 46 as shown in FIGS. 1 and 2. The upper surfaces of the spaced portions 6*c* of the first finger piece contain aligned concave recesses 48, respectively.

Referring now to FIGS. 14-17, the second finger portion 8 will be described in detail. The second finger portion includes an upper concave surface 50 which is configured to receive the pinkie finger of the archer. At one end of the second finger portion is a narrowed portion 8*a* which contains a transverse arcuate slot 52. Above the narrowed portion 8*a*, the second finger piece includes a transversely extending pivot portion 8*b*, the ends of which extend beyond the narrowed portion 8*a*. The pivot portion has a generally circular cross-sectional configuration.

The second finger piece 8 is connected with the first finger piece by inserting the narrowed portion 8*a* between the spaced portions 6*c* of the first finger piece and into the channel 40 with the opposite ends of the pivot portion 8*b* resting in the concave recesses 48 in the upper surface of the first finger piece spaced portions 6*c*, respectively. When so arranged, the slot 52 of the second finger piece narrowed portion 8*a* is aligned with the aligned openings 42, 44 in the first finger piece spaced portions 6*c*. A locking screw 46 is placed in the opening 42, passes through the slot 52, and into the opening 44 which is preferably a threaded opening. With the locking screw 46 in a release (untightened) condition, the second finger piece can be pivoted in either direction with respect to the first finger piece about the pivot portion 8*b*. The extent of displacement is a function of the arcuate length of the slot 52. The archer thus adjusts the second finger piece relative to the first finger piece to a desired location and tightens the locking screw 46. Tightening of the locking screw draws the spaced portions 6*b* of the first finger piece against the narrowed portion of the second finger piece to clamp or lock it in the selected position relative to the first finger piece. The bottom surface of the narrowed portion 8*a* of the second finger piece contains a plurality of alignment markings 56 which are used to indicate to the archer the selected radial position of the second finger piece relative to the first finger piece.

The handheld archery release with interchangeable finger pieces or portions allows radial adjustment of release providing the equivalent of a handle shape change for the archer. For a fulcrum back-tension release, adjusting the finger pieces forward creates a flatter hand feel and provides a faster back-tension speed for shot execution. Adjusting the finger pieces rearward or backward creates a larger arcuate shape for a more swept hand feel and a slower back-tension speed for shot execution.

While the invention has been illustrated and described for use in four finger release, it is applicable to two and three finger releases as well. In a two finger hand-held release, the handle includes a concave section for receiving a first finger, generally the index finger, and only a single finger piece is connected with the handle using the connection construction shown for the handle and first finger piece in the drawing. In a three finger release, the handle includes either an opening or a surface for the first finger and a surface for the second finger. A finger piece having a construction similar to the construction of the second finger piece 8 shown in FIGS. 14-17 is connected directly with the handle to accommodate the third finger. That is, a three finger back tension release would have a structure similar to that of FIGS. 1-3 except that the first finger piece 6 would be omitted.

What is important is that in any release incorporating the invention, at least one finger piece is removably and adjustably connected with a handle or handle portion.

While the preferred forms and embodiments of the invention have been illustrated and described, it will become apparent to those of ordinary skill in the art that various changes and modifications may be made without deviating from the inventive concepts set forth above.

What is claimed is:

1. An archery release, comprising (a) a handle including a first portion and an extended concave portion for receiving first and second fingers, respectively, of an archer, said handle having a longitudinal axis extending through said first and extended concave portions; and (b) a first finger piece pivotally connected with an end of said handle extended concave portion about a first pivot axis and adjustable through an arc spaced from said first pivot axis to provide radial adjustment of said first finger portion relative to said handle extended concave portion.

2. An archery release, comprising (a) a handle including a first portion containing a central opening and an integral extended concave portion for receiving first and second fingers, respectively, of an archer, said handle having a longitudinal axis extending transverse to an axis of said central opening and through said extended concave portion; and (b) a first finger piece removably and adjustably connected with said handle extended concave portion to provide radial adjustment of the release, an end of said handle concave portion containing a channel and a first end of said first finger piece containing a transverse slot, said first finger piece first end being slidably arranged in said handle channel, and further comprising a locking screw passing through said handle and said first finger piece slot to lock said first finger piece in a selected radial position relative to said handle end.

3. An archery release as defined in claim 2, wherein said handle end contains a recess adjacent said channel and said first finger piece first end further includes a pivot portion which rests in said handle recess when said first finger piece is connected with said handle extended concave portion, said first finger piece being pivotally adjustable relative to said handle when said locking screw is released and being locked into a selected radial position relative to said handle when said locking screw is tightened.

4. An archery release as defined in claim 3, and further comprising a second finger piece removably and adjustably connected with a second end of said first finger piece.

5. An archery release as defined in claim 4, wherein said first finger piece second end contains a channel and a first end of said second finger piece contains a transverse slot, said second finger piece first end being arranged in said first finger piece channel, and further comprising a second locking screw passing through said first finger piece and said second finger portion slot to connect said second finger portion with said first finger piece, said first finger piece second end containing a recess adjacent said channel and said second finger piece first end further including a pivot portion which rests in said first finger piece recess when said second finger piece is connected with said first finger piece, said second finger piece being pivotally adjustable relative to said first finger piece when said second locking screw is released and being locked into a selected radial position relative to said first finger piece when said second locking screw is tightened.

6. An archery release as defined in claim 5, wherein said first finger piece is radially adjustable up to 30° and wherein said second finger piece is radially adjustable up to 30°.

7. An archery release as defined in claim 2, wherein said handle first portion contains a recess in an outer surface thereof, and further comprising a sear assembly arranged in said recess and connected with said handle.

* * * * *